United States Patent [19]

Radek

[11] Patent Number: 4,678,151

[45] Date of Patent: Jul. 7, 1987

[54] MERCHANDISE HANGER FOR SLOTTED WALL DISPLAY PANEL

[75] Inventor: John R. Radek, Hinsdale, Ill.

[73] Assignee: Ready Metal Manufacturing Company, Chicago, Ill.

[21] Appl. No.: 849,848

[22] Filed: Apr. 9, 1986

Related U.S. Application Data

[63] Continuation-in-part of Ser. No. 626,532, Jun. 29, 1984, Pat. No. 4,607,753.

[51] Int. Cl.[4] ..... A47F 5/00

[52] U.S. Cl. ..... 248/220.2; 211/94; 211/59.1; 248/225.1

[58] Field of Search ..... 248/220.2, 222.1, 222.2, 248/225.1, 295.1, 298; 211/57.1, 59.1, 87, 94

[56] References Cited

U.S. PATENT DOCUMENTS

| | | | |
|---|---|---|---|
| 3,136,523 | 6/1964 | Munroe | 248/222.1 X |
| 4,327,888 | 5/1982 | Scheneman | 248/222.1 X |
| 4,591,058 | 5/1986 | Amstutz et al. | 211/87 |

FOREIGN PATENT DOCUMENTS

| | | | |
|---|---|---|---|
| 823241 | 10/1951 | Fed. Rep. of Germany | 248/295.1 |

*Primary Examiner*—Robert W. Gibson, Jr.

*Attorney, Agent, or Firm*—Samuel Lebowitz; George F. Dvorak

[57] ABSTRACT

A hanger support for small articles of merchandise, which support is adapted for detachable mounting at any point along the length of a slat forming a component of a slotted wall merchandise display panel having horizontal grooves between adjacent slats. The support assembly is formed by a main plate, to the front face of which is affixed a cantilever bar from which the merchandise items are suspended. An integral offset retaining flange is bent from the upper end of the plate for entry within the desired portion of the groove above the selected slat. A secondary offset retaining flange is provided on an auxiliary plate which is vertically slideable on the main plate and which encompasses the rear face of the latter and is bent over the lateral edges of the main plate to provide reliable guide tracks for the relative movements between the plates, between their nested and extended positions. Following the above-mentioned entry of the first-mentioned flange in the groove, the assembly is free to assume a position adjacent to the slat whereupon the secondary retaining flange is free to drop past the groove below the slat into engagement with the rear portion of the slat therebelow, thereby to securely fix the position of the assembly onto the first-mentioned slat by interengagement of the rear portions of the slats above and below it with retaining flanges of substantial areas.

6 Claims, 3 Drawing Figures

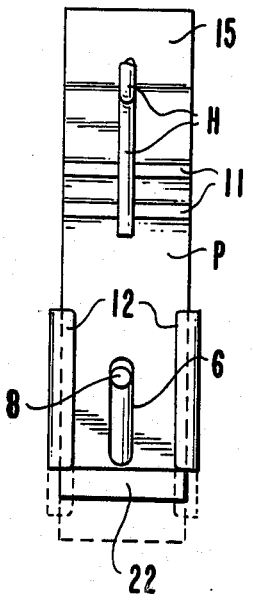
Fig. 2
Fig. 1
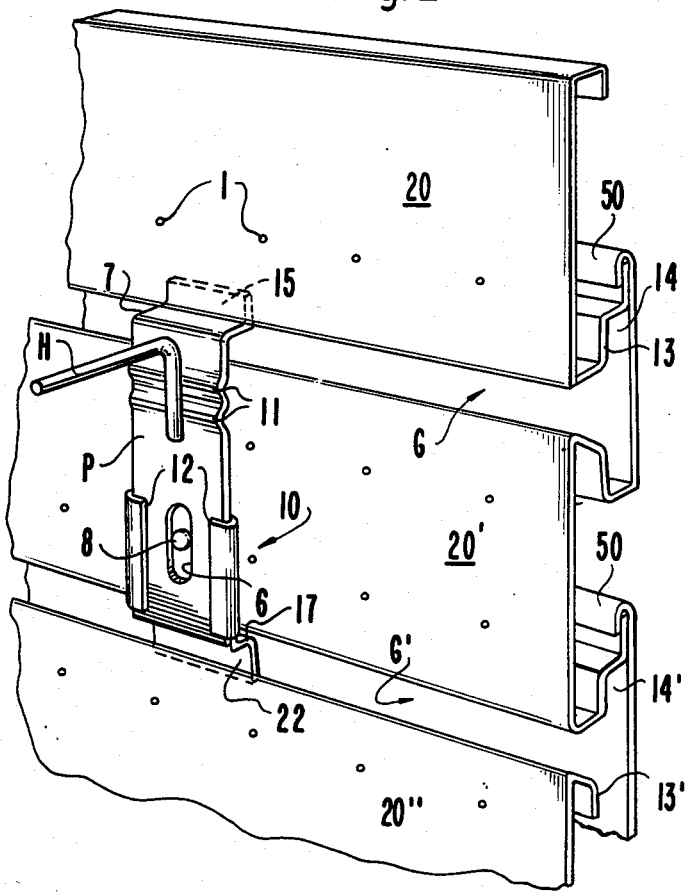
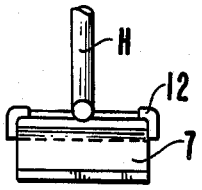
Fig. 3

MERCHANDISE HANGER FOR SLOTTED WALL DISPLAY PANEL

This application is a continuation-in-part of my pending application Ser. No. 626,532, filed June 29, 1984, which matured into U.S. Pat. No. 4,607,753, Aug. 26, 1986.

The present invention concerns a hanger which is specially suitable for displaying small articles of merchandise suspended on a cantilever hanger adapted to be detachably mounted on a slotted wall display panel, as disclosed in the above-mentioned application.

It is the object of the present invention to provide a rugged and reliable hanger for adjustable selected mounting on spaced slats of a slotted wall merchandise display panel having horizontal grooves between the adjacent slats.

It is another object of the invention to facilitate the adjustable mounting and detachment of cantilever hangers on slotted wall merchandise display panels provided with horizontal grooves between adjacent slats, to complement other types of hangers provided with prongs for mounting on wall panels provided with aligned apertures therein of the type disclosed in applicant's U.S. Pat. No. 3,677,415, July 18, 1972.

Other objects and purposes will appear from the detailed description of the invention following hereinafter, taken in conjunction with the accompanying drawing, wherein FIG. 1 is a perspective view of a perferred embodiment of the invention mounted on a slotted wall merchandise display panel;

FIG. 2 is a front elevation of the hanger; and

FIG. 3 is a plan view of FIG. 2.

In FIG. 1 of the drawing is shown a slotted wall merchandise display panel constituted by a plurality of superposed slats 20,20', 20'', etc., which are interconnected with each other to provide horizontal grooves G,G' between adjacent slats. The slats may be of plain rigid sheet material or may be provided with aligned apertures 1, as shown. The wall formed by the slats may be mounted against a building wall or on tandem frames as disclosed in my U.S. Pat. No. 4,093,078, June 6, 1978. The slats constituting the walls are integrated in any suitable way, for example, by reversely bent flanges at the top of one slat interengaging an interfitting flange at the bottom of the slat thereabove as shown at 50 in FIG. 1, or by screw fasteners (not shown), all of which are fully described and illustrated in the above-mentioned parent application.

The rugged hanger assembly in accordance with the invention, for adjustable mounting on any slat at any desired point thereof is constituted by a rectangular plate P which has ridges 11 adjacent the upper end thereof to provide secure welding or soldering areas for the vertical arm of the cantilever hanger H, the horizontal arm of which projects forwardly therefrom. The hanger H supports the small articles of merchandise, which may be positioned along the slat 20' at any part thereof for cooperation with any other hanger devices mounted on the display panel, for example, those provided with prongs for engagement with apertures in the slats, of the type disclosed in my above-mentioned U.S. Pat. No. 3,677,415.

The plate P is bent rearwardly at the top thereof at 7 and a retaining flange 15 is bent upwardly from the latter for insertion into the groove G and ultimate engagement thereof with the rear portion of the slat 20 adjacent to the lower edge thereof, against the vertical extension 13, spaced from the front of the panel.

An auxiliary plate 10 is slidably mounted along the lower portion of plate P. The former spans the entire width of the rear face of plate P and is bent forwardly over the lateral edges of the latter to form tracks 12 for guiding smoothly relative movement between the plates P. The bottom edge of the plate 10 is bent rearwardly at 17 and a retaining flange 22 is bentdownwardly therefrom in substantially the same plane as retaining flange 15 at the top of plate P.

When the upper end of the hanger assembly is inserted into the groove G with some degree of tilting and the plate P is disposed adjacent to the panel 20', the parts 17 and 22 of auxiliary plate 10 are free for entry into the groove G' whereat the same may drop so that the retaining flange 22 may engage the rear upper portion of the slat 20'' by its seating against the spaced vertical extension 13' bent from slat 20'' and forming the front wall of cavity 14' which houses the retaining means for the hanger assembly.

The horizontal grooves G, G' on the front of the display panel may vary in height, as long as they accommodate the entry and withdrawal of the opposite ends of the hanger assembly as described above. In the preferred embodiment of the invention, which is described and illustrated in the above-mentioned parent application, the grooves between the slats at the front thereof are approximately one-fourth the height of the slats wherefrom flaring passages extend rearwardly therefrom to cavities 14, 14' having a height of approximately one-half the height of the slats, whereat are provided the vertical extension seating surfaces 13, 13' for the retaining flanges 15 and 22.

The extent of the vertical movement between the main plate P and the auxiliary plate 10 is preferably controlled by cooperating means on these elements. One example of several envisioned cooperating means utilizes a protuberance or projection 8 on the auxiliary plate engaging a vertical longitudinal slot 6 at the midportion of the main plate, the ends of which control the limits of travel of the plate 10 relative to plate P.

The lifting of the retaining flange 22 from engagement with extension 13' permits rocking the lower end of the hanger assembly to enable the withdrawal of the upper retaining flange 15 from behind extension 13, and the detachment of the hanger assembly for positioning at some other location of the display panel.

While I have described my invention as embodied in a specific form and as operating in a specific manner for purposes of illustration, it should be understood that I do not limit my invention thereto, since various modifications will suggest themselves to those skilled in the art without departing from the spirit of my invention, the scope of which is set forth in the annexed claims.

I claim:

1. A hanger support for displaying small articles of merchandise on a generally planar slotted wall merchandise display panel having horizontal grooves between opposed edges of adjacent slats forming the wall, comprising (a) an assembly of a length approximately the height of the slats adapted to be detachably connected to a first slat at any point along the length thereof and having a cantilever hanger projecting forwardly therefrom for supporting and displaying the small articles of merchandise, (b) said assembly comprising a main plate having said hanger affixed to the front face of said plate and a first offset retaining flange bent rearwardly from one end thereof and adapted for insertion into a first groove adjacent to said slat for ultimate disposition in a plane substantially parallel to said slat and in engagement with the rear portion of a second slat adjacent to said first slat, (c) an auxiliary plate spanning the entire width of the rear face of said main plate and mounted for slideable movement thereon adjacent to the end thereof remote from said first flange, (d) cooperating means on said plates for limiting the extent of the sliding movement therebetween, and (e) secondary retaining means on the free end of said auxiliary plate adapted for insertion into a second groove adjacent to the opposite edge of said first slat for engagement with the rear portion of a third slat adjacent to and beyond said second groove.

2. A device as set forth in claim 1, wherein the lateral edges of said auxiliary plate are bent forwardly over the lateral edges of said main plate to provide tracks for guiding the slidable movements between said plates.

3. A device as set forth in claim 1, wherein said secondary retaining means comprises a second retaining flange bent rearwardly from the free end of said auxiliary plate in substantially the same plane as said first flange.

4. A hanger support for displaying small articles of merchandise on a generally planar slotted wall merchandise display panel having horizontal grooves between opposed edges of adjacent slats forming the wall, comprising (a) an assembly of a length approximately the height of the slats adapted to be detachably connected to a first slat at any point along the length thereof and having a cantilever hanger projecting forwardly therefrom for supporting and displaying the small articles of merchandise, (b) said assembly comprising a rectangular main plate having said hanger affixed to the front face of said plate and a first integral offset retaining flange bent rearwardly from the upper end thereof and adapted for insertion into a first groove immediately above said first slat for ultimate disposition in a plane substantially parallel to said first slat and in engagement with the bottom rear portion of a second slat above said first slat, (c) an auxiliary plate spanning the entire width of the rear face of said main plate and overlapping the lateral edges of said main plate at the lower portion thereof from said flange, for guiding the vertical movement of said auxiliary plate relative to said main plate between a position whereat the main plate totally overlaps said auxiliary plate and one whereat the lower portion of the auxiliary plate extends below said main plate, (d) cooperative means on said plates for limiting the extent of said vertical movement, and (e) a second retaining flange bent rearwardly from the lower portion of said auxiliary plate in substantially the same plane as said first flange, and adapted for insertion into a second groove below said first slat for engagement with the rear portion of a third slat below said second groove in the extended position of said auxiliary plate.

5. A device as set forth in claim 4, wherein said cooperative means on said plates for limiting the extent of relative movement therebetween comprises a vertical slot in said main plate at the midportion thereof adjacent to the end remote from said first flange, and a projection on the inner face of said auxiliary plate extending into said vertical slot adapted to be stopped by the ends of said slot.

6. A device as set forth in claim 4, wherein said cooperative means on said plates for limiting the extent of relative movement therebetween comprises a vertical slot in said auxiliary plate at the main portion thereof, and a projection on the inner face of said main plate extending into said vertical slot, the extent of movement of said projection being limited by said slot.

* * * * *

UNITED STATES PATENT AND TRADEMARK OFFICE

CERTIFICATE OF CORRECTION

PATENT NO. : 4,678,151

DATED : July 7, 1987

INVENTOR(S) : John R. Radek

It is certified that error appears in the above-identified patent and that said Letters Patent is hereby corrected as shown below:

Column 4, line 11, insert --remote-- after "thereof".

Signed and Sealed this

Eighth Day of December, 1987

*Attest:*

DONALD J. QUIGG

*Attesting Officer*

*Commissioner of Patents and Trademarks*